United States Patent [19]

Keglewitsch et al.

[11] Patent Number: 4,500,161

[45] Date of Patent: Feb. 19, 1985

[54] ELECTRICAL CONNECTOR WITH SLIDING COLLAR

[75] Inventors: Josef Keglewitsch; Theodore J. Stechschulte, both of Bowling Green, Ohio

[73] Assignee: Marathon Electric Mfg. Corp., Wausau, Wis.

[21] Appl. No.: 489,202

[22] Filed: Apr. 27, 1983

[51] Int. Cl.[3] ..... H01R 4/36

[52] U.S. Cl. ..... 339/242

[58] Field of Search ..... 339/198 N, 22 B, 242, 339/272 R

[56] References Cited

U.S. PATENT DOCUMENTS

| | | | |
|---|---|---|---|
| 2,748,365 | 5/1956 | Speck | 339/198 N |
| 3,018,464 | 1/1962 | Mrenna et al. | 339/242 |
| 3,727,171 | 4/1973 | Coles et al. | 339/22 B |
| 4,231,633 | 11/1980 | Luke et al. | 339/242 |

*Primary Examiner*—Joseph H. McGlynn

*Assistant Examiner*—Paula Austin

*Attorney, Agent, or Firm*—Andrus, Sceales, Starke & Sawall

[57] ABSTRACT

A connector assembly for providing contact between the conductors of an electric power cable and a plurality of leads. The connector assembly includes a distribution block connected to the leads, and a connector slidably mounted on the block for providing contact between the cable conductors and the block. The connector includes a split collar for receiving and clamping about the cable conductors and a pair of opposing legs projecting outwardly from the free ends thereof. The legs are slidably received within a channel formed along one side of the block for selective positioning thereon. A set screw secures the cable conductors within the connector and simultaneously fixes the location of the connector on the block and assures intimate contact of the connector with the block by spreading the legs of the connector to firmly engage the sides of the channel.

9 Claims, 3 Drawing Figures

ELECTRICAL CONNECTOR WITH SLIDING COLLAR

BACKGROUND OF THE INVENTION

The present invention relates to electrical connectors, and more particularly to an electrical connector for a junction box that provides contact between the conductors of an electric power cable and a plurality of leads.

Various types of connector assemblies are known in the prior art. For example, U.S. Pat. Nos. 4,231,633 and 3,727,171 each show connector assemblies having an elongated terminal bar for receiving a sliding terminal connector which is adapted to receive a suitable cable conductor. A set screw fixes the location of the connector on the terminal bar. However, when stripping and preparing the end of a large power cable for such connector assemblies, it is critical to have the correct length since such connectors cannot readily adjust to variations in cable length. In addition, cable of the type utilized in such assemblies is very stiff and adjusting the length of the cable is difficult and thus inserting the conductors into connector holes is extremely difficult.

There is a need for a connector assembly which can receive a cable which is not of just one predetermined length, and which avoids the difficulties of inserting stiff conductors into a terminal connector.

SUMMARY OF THE INVENTION

A connector assembly provides connection between the conductors of an electric power cable and a plurality of leads. The assembly includes a distribution block connectable to the leads, and a terminal connector slidably mounted on the block for selective positioning thereon for providing electric connection between the power cable and the block. In a preferred connector assembly, the terminal connector includes a split collar body for receiving and clamping about the end of the cable which normally includes multi-strand conductors. The sliding connection between the connector and block is provided by a pair of opposing legs projecting outwardly from the free ends of the split collar which are slidably received within a channel formed along one side of the block.

The terminal connector is slidable in a direction corresponding to the longitudinal axis of the cable. This feature enables the connector to adapt to various lengths of cable. Thus, the criticality of stripping and preparing the cable to the correct length is reduced since the terminal connector can adapt to various lengths by sliding in the channel. In addition, the relatively stiff cable may be easily inserted into the connector since there is no need to substantially bend the conductors.

A set screw assures intimate contact of the wire conductors with the connector and the connector with the block. Set screw pressure on the end of the cable simultaneously fixes the ends of the cable conductors in the connector and fixes the location of the connector on the block by spreading the legs of the connector to engage the sides of the channel in the block.

In one form, the block is removably mounted on a base in spaced relation to a surface and oriented for example to receive a large diameter and vertically oriented power cable. The base includes stop means for limiting the vertical sliding movement of the connector so that once the base and block are assembled the connector cannot be removed from the channel. The stop means includes a pair of projections extending from the base at spaced apart locations to overlap opposite ends of the channel.

The present invention thus provides a connector assembly for providing contact between the conductors of an electric power cable and a plurality of leads that readily adapts to different cable lengths and provides ease of assembly of the terminal connector and cable.

BRIEF DESCRIPTION OF THE DRAWINGS

The drawings illustrate the best mode presently contemplated of carrying out the invention.

In the drawings

DESCRIPTION OF THE PREFERRED EMBODIMENT

Figure 1:
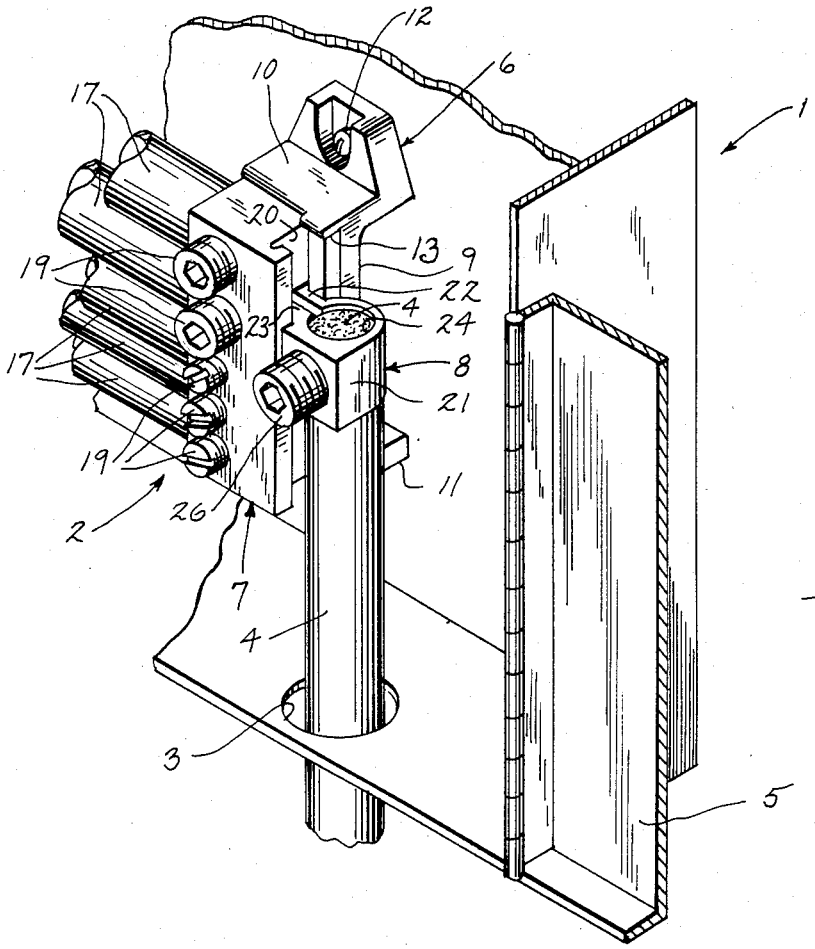
FIG. 1 is a fragmentary perspective view of a junction box incorporating the connector assembly of the present invention.

Referring now the drawings, FIG. 1 shows a junction box 1 incorporating a connector assembly 2 constituting a preferred embodiment of the present invention. As shown, junction box 1 is of a typical construction having a hole 3 in is bottom wall through which an electric power cable 4 passes. Junction box 1 also includes a door 5 hinged to one of its side walls to provide a closure for its front. It should be noted that although connector assembly 2 is illustrated herein for use in a junction box environment, other applications may also be possible.

Figure 2:
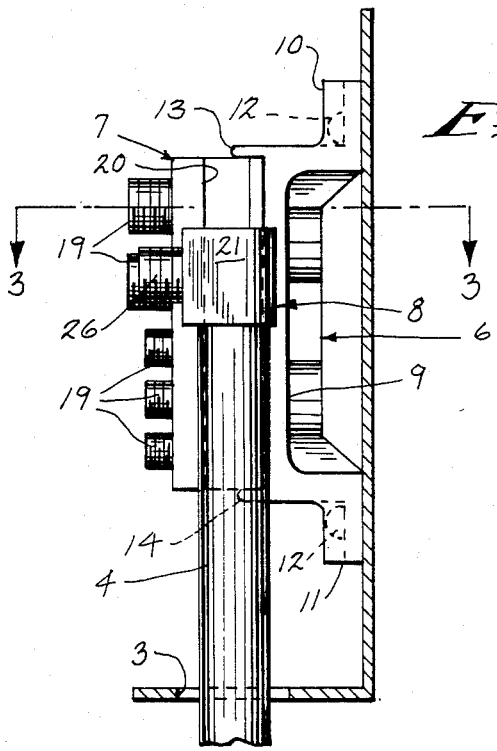
FIG. 2 is a side view in elevation of the connector assembly of FIG. 1.

Connector assembly 2 includes a base 6, a distribution block 7 and a terminal connector 8. As shown best in FIG. 2, base 6 includes a flat plate 9 and a pair of L-shaped mounting legs 10 and 11. Base 6 is mounted by screws 12 which pass through legs 10 and 11 into the rear wall of box 1 so that its longitudinal extent in orientated vertically, as best seen in FIGS. 1 and 2. Base 6 also includes an upper stop or projection 13 and a lower stop or projection 14 integrally formed thereon which project from opposite ends of the surface of plate 9 at its righthand side edge. The purpose of stops 13 and 14 will hereinafter be more fully described.

Distribution block 7 is rectangular in shape having a width and length substantially identical to the width and length of plate 9 of base 6. As seen best in FIG. 3, block 7 is removably mounted to base 6 by a pair of screws 15 which pass through plate 9 into the back side of block 7. A plurality of parallel wire-receiving bores 16 are formed along the lefthand side of block 7. The bores 16 extend transversely and sideways into block 7 and are spaced along the longitudinal extent thereof for receiving a plurality of leads 17. An individual threaded aperture 18 extends from each of the bores 16 to the front of block 7. Apertures 18 normally receive holding screws 19 which engage the ends of leads 17 disposed in bores 16 to assure intimate contact of the leads 17 and block 7. Block 7 also includes a substantially T-shaped channel 20 formed therein on the opposite side from that of bores 16, i.e. the righthand side of block 7. Channel 20 runs the entire longitudinal extent of block 7, and as shown best in FIG. 3, has a width which is greater than its depth.

Figure 3:
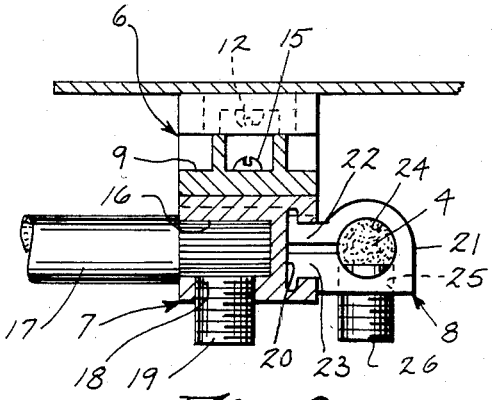
FIG. 3 is a view in cross section taken along the plane of the line 3—3 in FIG. 2.

As seen best in FIG. 3, terminal connector 8 is in the form of a split collar clamp having a cylindrical body 21 and a pair of opposing legs 22 and 23 projecting outwardly from the free ends of body 21. Body 21 includes an axial opening extending therethrough for receiving the ends of the conductors of cable 4. A threaded aperture 25 extends from opening 24 to the front of connector 8, and receives a set screw 26 which engages the ends of the conductors of cable 4. Legs 22 and 23 have a T-shaped cross section corresponding to the T-shaped channel 20. As seen best in FIG. 2, stops 13 and 14 project from base 6 to overlap the opposite open ends of channel 20. Stops 13 and 14 thus limit the sliding movement of connector 8 in channel 20 so that connector 8 cannot be removed from channel 20 without first removing block 7 from base 6.

In operation, cable 4 is first prepared by stripping the insulation therefrom to reveal the ends of its conductors. Connector 8 can then be slid vertically within channel 20 over the ends of the conductors of cable 4. Set screw 26 may then be turned down into aperture 25 to engage the cable conductors to insure intimate contact of the conductors with connector 8. As screw 26 engages the conductors its pressure thereon simultaneously causes legs 22 and 23 to spread outwardly from one another to fix the location of connector 8 on block 7. As legs 22 and 23 spread they engage the sides of channel 20 and assure intimate contact of connector 8 with block 7. Since connector 8 slides parallel to the longitudinal axis of cable 4, there is no need to substantially bend cable 4 in order to insert its conductor ends into connector 8. In addition, such movement enables connector 8 to readily adapt to various lengths of cable 4.

A connector assembly for providing contact between the conductors of an electric power cable and a plurality of leads has been illustrated and described. The assembly includes a distribution block 7 connectable to the leads and a terminal connector 8 slidably mounted on block 7 for selective positioning thereon. Connector 8 is simultaneously connectable to cable 4 and block 7. Block 7 is removably mounted on a base 6 which in turn may be mounted on any convenient surface, such as in a junction box.

It should be noted that various modifications and/or substitutions of the specific components described herein may be made without departing from the scope of the invention. For example, one or more connectors 8 may be utilized and each connector 8 need not necessarily be of the same size or shape as the one specifically described herein. Also, other cross sectional configurations for legs 22 and 23 which are basically T-shaped may be utilized other than that specifically shown in FIG. 3.

Various modes of carrying out the invention are contemplated as being within the scope of the following claims particularly pointing out and distinctly claiming the subject matter which is regarded as the invention.

We claim:

1. A connector assembly for providing connection between the conductors of an electric power cable and a plurality of leads, comprising:

a distribution block connectable to said leads, said block having a channel formed along one side thereof;

a terminal connector slidably mounted on said block for selective positioning thereof to provide contact between the cable and the block, said connector including a split collar body having an axial opening for receiving the ends of said conductors, a threaded bore communicating with said axial opening and extending normal thereto, and a pair of opposing legs projecting outwardly from the free ends thereof slidably received within said channel; and a set screw disposed in said bore and engageable with the ends of said conductors to provide intimate contact between the conductors and the connector and to simultaneously spread said legs against the sides of said channel to provide intimate contact between said connector and said block.

2. The connector assembly of claim 1, wherein the cross sectional configuration of said legs corresponds to the cross sectional configuration of said channel.

3. The connector assembly of claim 2, wherein said cross sectional configurations are substantially T-shaped.

4. A connector assembly for providing connection between the conductors of an electric power cable and a plurality of leads, comprising:

a distribution block connectable to said leads, said block having a channel formed along one side thereof;

a terminal connector slidably mounted on said block for selective positioning thereof to provide a connection between the cable and the block, said connector including a split collar body having an axial opening for receiving the ends of said conductors, a threaded bore communicating with said axial opening and extending normal thereto, and a pair of opposing legs projecting outwardly from the free ends thereof slidably received within said channel;

a set screw disposed in said bore and engageable with the ends of said conductors to provide intimate contact between the conductors and the connector and to simultaneously spread said legs against the sides of said channel to provide intimate contact between said connector and said block; and a base for removably mounting said block in spaced relation to a surface, said base including stop means for limiting the sliding movement of said connector.

5. The connector assembly of claim 4, wherein said stop means includes a pair of spaced apart lugs projecting from said base.

6. The connector assembly of claim 5, wherein said lugs are located at opposite ends of said channel.

7. A connector assembly for providing connection between a large electric power cable and a plurality of leads, comprising:

a distribution block connectable to said leads, a terminal connector having an axial opening for receiving said cable, a sliding coupling between said distribution block and said terminal connector for selective positioning to provide a connection between the cable and the block, said coupling including a first part integral with said distribution block and a second part integral with said terminal connector, one of said parts having a channel coupling member and the other of said parts having a sliding projection coupling member in said channel, said second part being split from said opening into said coupling member to permit opening and closing said opening for receiving said cable and for clamping said second part in position relative to said first part, and a cable securement member adapted to move said second part to selectively open and close said opening in said second part.

8. The connector assembly of claim 7 wherein said first part is a channel formed along one side of the block, said terminal connector is a split collar and said second part includes a pair of opposing legs projecting outwardly from said collar and slidably received within said channel, said collar including a threaded bore communicating with said axial opening and extending normal thereto, said securement means being a set screw disposed in said bore and engageable with the ends of said cable to provide intimate contact of cable to the connector and to simultaneously spread said legs against the sides of said channel to provide intimate contact between said connector and said block.

9. The connector assembly of claim 7 having a mounting base, means securing the block to the mounting base, and stops on said base located at opposite ends of said channel to limit movement of said terminal connector.

* * * * *